US008914280B2

(12) United States Patent
Sung et al.

(10) Patent No.: US 8,914,280 B2
(45) Date of Patent: Dec. 16, 2014

(54) METHOD AND APPARATUS FOR ENCODING/DECODING SPEECH SIGNAL

(75) Inventors: Ho Sang Sung, Yongin-si (KR); Eun Mi Oh, Seongnam-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 590 days.

(21) Appl. No.: 12/458,961

(22) Filed: Jul. 28, 2009

(65) Prior Publication Data

US 2010/0114566 A1 May 6, 2010

(30) Foreign Application Priority Data

Oct. 31, 2008 (KR) ..... 10-2008-0108106

(51) Int. Cl.
*G10L 19/00* (2006.01)

(52) U.S. Cl.
USPC ..... 704/219; 704/223; 704/229; 704/230

(58) Field of Classification Search
USPC ..... 704/200–230, 500–504, 240.3
See application file for complete search history.

(56) References Cited

U.S. PATENT DOCUMENTS

| | | | | |
|---|---|---|---|---|
| 6,647,366 | B2 | 11/2003 | Wang et al. | |
| 6,895,052 | B2 * | 5/2005 | Hanamura et al. | 375/240.03 |
| 7,254,533 | B1 * | 8/2007 | Jabri et al. | 704/219 |
| 7,406,412 | B2 * | 7/2008 | Vernon et al. | 704/229 |
| 7,848,922 | B1 * | 12/2010 | Jabri et al. | 704/219 |
| 7,933,769 | B2 * | 4/2011 | Bessette | 704/219 |
| 8,160,872 | B2 * | 4/2012 | Stachurski | 704/225 |
| 2007/0282603 | A1 * | 12/2007 | Bessette | 704/219 |
| 2008/0249783 | A1 * | 10/2008 | Stachurski | 704/500 |

FOREIGN PATENT DOCUMENTS

| | | |
|---|---|---|
| JP | 2008-090311 | 4/2008 |
| KR | 10-1999-0088578 | 12/1999 |
| KR | 10-2005-0066996 | 6/2005 |
| KR | 10-2008-0053131 | 6/2008 |

* cited by examiner

*Primary Examiner* — Huyen X. Vo
(74) *Attorney, Agent, or Firm* — Staas & Halsey LLP

(57) ABSTRACT

An apparatus and method for encoding/decoding a speech signal which determines a variable bit rate based on reserved bits obtained from a target bit rate, is provided. The variable bit rate is determined based on a source feature of the speech signal and the reserved bits is obtained based on the target bit rate. The apparatus for encoding the speech signal may include a linear predictive (LP) analysis unit/quantization unit to determine an immittance spectral frequencies (ISF) index, a closed loop pitch search unit, a fixed codebook search unit, a gain vector quantization (VQ) unit to determine a gain vector quantization (VQ) index, and a bit rate control unit to control at least two indexes of the ISF index, the pitch index, the code index, and the gain VQ index to be encoded to be variable bit rates based on a source feature of a speech signal and the reserved bits.

26 Claims, 8 Drawing Sheets

METHOD AND APPARATUS FOR ENCODING/DECODING SPEECH SIGNAL

CROSS-REFERENCE TO RELATED APPLICATIONS

This application claims the benefit of Korean Patent Application No. 10-2008-0108106, filed on Oct. 31, 2008, in the Korean Intellectual Property Office, the disclosure of which is incorporated herein by reference.

BACKGROUND

1. Field

One or more embodiments relate to a method and apparatus for encoding/decoding a speech signal, and more particularly, to a method and apparatus for improving a sound quality of a speech signal by encoding and decoding the speech signal based on a variable bit rate.

2. Description of the Related Art

Speech transmission using digital technologies is widespread and such a trend is more noticeable in long distance and digital wireless telephone applications. Consequently, there have been increased interests in determining the minimum amount of information that would need to be transmitted via a channel while maintaining sufficient quality for speech restoration. When speech is transmitted using simple sampling and digitizing, a data transmission rate of 64 kbps is required for speech quality matching that of a conventional analog telephone. However, even with adequate coding and a speech analysis after restoration in a transmission unit and a receiving unit, there may be significant reduction in a data transmission rate.

Accordingly, there have been attempts to overcome these drawbacks by the use of speech coders that utilize speech compression techniques based on extracting parameters related to a modeling of human speech generation, i.e., rather than a straight sampling and digitalizing of a speech signal. Such speech coders divide input speech signals into time blocks or analytic frames. In general, speech coders include an encoder and a decoder. The encoder analyzes input speech frames by extracting such specific related parameters, and performs quantization so that the input speech frames may be expressed in binary such as sets of bits or binary packets, for example. The data packets are transmitted to receiving units or decoders using the communication channel. The decoder processes the data packets, and performs a quantization for the data packets to generate the parameters, and restores speech frames using the generated parameters.

One such speech coder is the Code Excited Linear Predictive (CELP) coder, cited as a reference in L. B. Rabiner & R. W. Schafer "Digital processing of the speech signals 396-453 (1978)". In the CELP coder, short term relations or redundancies in the speech signals are removed by linear predictive (LP) analysis which looks for the short term Formant filter coefficients. By applying the short term predictive filters to input speech frames, LP remaining signals are generated, and these signals are further modeled, and quantized into statistic codebooks in which they are with the long term predictive filter parameters.

Consequently, CELP coding separates an encoding task for a speech waveform of a time domain into an encoding of the short term filter coefficient and an encoding of the LP remaining signals.

CELP coding may be performed at a fixed rate (for example, identical bits per frame). However, it may not be efficient as identical bits are allocated in both cases of when a larger number of bits would be required due to existence of speech signals, compared to when a smaller number of bits would be required due to non-existence of speech signals such as with silence.

Also, CELP coding may be operated at variable rates (different frame rates applied to different types of frame contents). A variable bit rate coder performs encoding of bits required at a level adequate for codec parameters to achieve a target quality. However, the coding methods based on the variable bit rates which are presently used only select a bit rate appropriate for circumstances from among several bit rates, and thus there is a limit in applicable bit rates.

SUMMARY

One or more embodiments may provide an apparatus and method for encoding/decoding a speech signal which may improve a quality of the speech based on a variable bit rate.

One or more embodiments may also provide an apparatus and method for encoding/decoding a speech signal which determines a variable bit rate according to reserved bits obtained based on a target bit rate.

Still further, one or more embodiments may also provide an apparatus and method for encoding/decoding a speech signal which determines a variable bit rate according to a source feature of the speech signal and reserved bits obtained based on a target bit rate.

According to one or more embodiments, there may be provided an apparatus for encoding a speech signal including a linear predictive (LP) analysis unit/quantization unit to determine an immittance spectral frequencies (ISF) index, a closed loop pitch search unit to determine a pitch index, a fixed codebook search unit to determine a code index, a gain vector quantization (VQ) unit to determine a gain VQ index of each of an adaptive codebook and a fixed codebook, and a bit rate control unit to control at least two indexes of the ISF index, the pitch index, the code index, and the gain VQ index to be encoded to be variable bit rates based on a source feature of a speech signal and reserved bits.

In one or more embodiments, the bit rate control unit may update the reserved bits every time each of the ISF index, the pitch index, the code index, and the gain VQ index is determined.

In one or more embodiments, the bit rate control unit may compare the reserved bits with reference values for selecting a linear predictive coefficient quantizer for the control of the variable bit rate of the ISF index, and may select a linear predictive coefficient quantizer based on the comparison result.

In one or more embodiments, the bit rate control unit may select a first quantizer for the control of the variable bit rate of the ISF index when the source feature is silence or a background noise, may select a second quantizer when the source feature is an unvoiced sound, selects a third quantizer when the source feature is a voiced sound and a signal change of the speech signal is less than a signal change of a reference frame, may select a fourth quantizer when the source feature is a voiced sound and the reserved bits is less than a predetermined value and a signal change of the speech signal is greater than or equal to a signal change of the reference frame, and may select a fifth quantization when the source feature is a voiced sound and the reserved bits is greater than the predetermined value and a signal change of the speech signal is greater than or equal to a signal change of the reference frame.

In one or more embodiments, each of the first quantizer, the second quantizer, the third quantizer, the fourth quantizer, and the fifth quantizer may respectively use a quantizer of a different size or a different scheme when quantization is performed.

In one or more embodiments, the ISF index may include quantizer information which is selected for ISF in the bit rate control unit.

In one or more embodiments, the bit rate control unit may search for an optimal pitch period for the control of the variable bit rate of the pitch index, and calculate and determine a pitch index with respect to a difference between a pitch period of a previous frame and the optimal pitch period when the difference is less than a reference value.

In one or more embodiments, the bit rate control unit may calculate and determine the pitch index with respect to the optimal pitch period when the difference is greater than the reference value.

In one or more embodiments, the pitch index may include a pitch allocation bit which includes information about an amount of bits expressing the pitch index.

In one or more embodiments, for the control of the variable bit rate of the code index, the bit rate control unit may compare the reserved bits with reference values for selecting a predetermined fixed codebook, and select a fixed codebook based on the comparison result.

In one or more embodiments, the bit rate control unit may identify a fluctuation feature of the reserved bits by comparing a previous reserved bits with the reserved bits for the control of the variable bit rate of the code index, classify a criterion for selecting the plurality of fixed codebooks as reference values for an increase feature when the reserved bits represents the increase feature, and select a fixed codebook, from the plurality of fixed codebooks as reference values for the increase feature, corresponding to the reserved bits.

In one or more embodiments, the bit rate control unit may classify the criterion for selecting a plurality of fixed codebooks as reference values for a decrease feature when the reserved bits represents the decrease feature, and selects a fixed codebook, from the plurality of fixed codebooks as reference values for the decrease feature, corresponding to the reserved bits.

In one or more embodiments, the code index may include information about the selected fixed codebook.

In one or more embodiments, for the control of the variable bit rate of the gain VQ index, the reserved bits may be compared with reference values for selecting a predetermined gain quantizer, and a gain quantizer may be selected based on the comparison result.

In one or more embodiments, the bit rate control unit may select a predetermined quantizer corresponding to the reserved bits for the control of the variable bit rate of the gain VQ index when a gain is quantized.

In one or more embodiments, the gain VQ index may include the selected quantizer information.

According to one or more embodiments, there may be provided an apparatus for decoding a speech signal including a demultiplexing unit to receive and to demultiplex a variable bit rate bitstream, and to extract an ISF index, a gain VQ index, a code index, and a pitch index from the variable bit rate bitstream, a linear predictive coefficient decoding unit to decode a linear predictive coefficient using quantizer information included in the ISF index, a gain decoding unit to decode an adaptive codebook and a fixed codebook gain using the quantizer information included in the gain VQ index, a fixed codebook decoding unit to decode a fixed codebook vector using the fixed codebook information used in the code index, an adaptive codebook decoding unit to decode an adaptive codebook vector using pitch allocation bit information included in the pitch index, an excitation signal configuration unit to configure an excitation signal by multiplying each decoded gain from the gain decoding unit by the fixed codebook vector and the adaptive codebook vector and by summing results of the multiplying, and a synthesis filter unit to synthesize the excitation signal with the ISF index, and a post-processing unit to post-process the speech signal.

According to one or more embodiments, there may be provided a method for encoding a speech signal including determining an ISF index using a variable bit rate based on at least one of a source feature and the reserved bit rate, determining a pitch index, determining a code index based on the reserved bits and a fluctuation feature of the reserved bits, determining a gain VQ index based on the reserved bits, and generating a variable bitstream including all of the determined ISF index, the pitch index, the code index, and the gain VQ index.

In one or more embodiments, the method for encoding the speech signal may further include updating the reserved bits every time each of the ISF index, the pitch index, the code index, and the gain VQ index is determined.

In one or more embodiments, the determining of the ISF index may further include comparing the reserved bits with reference values for selecting a linear predictive coefficient quantizer for the control of the variable bit rate of the ISF index, and selecting a linear predictive coefficient quantizer based on the comparison result.

In one or more embodiments, the determining of the ISF index may include identifying the source feature and the reserved bit rate, selecting a first quantizer for the control of the variable bit rate of the ISF index when the source feature is silence or a background noise, selecting a second quantizer when the source feature is an unvoiced sound, selecting a third quantizer when the source feature is a voiced sound and when a signal change of the speech signal is less than a signal change of a reference frame, selecting a fourth quantizer when the source feature is a voiced sound and a signal change of the speech signal is greater than or equal to a signal change of the reference frame and the reserved bits is less than a predetermined value, and selecting a fifth quantization when the source feature is a voiced sound and a signal change of the speech signal is greater than or equal to a signal change of the reference frame and the reserved bits is greater than the predetermined value.

In one or more embodiments, each of a first quantizer, a second quantizer, a third quantizer, a fourth quantizer, and a fifth quantizer may respectively use a quantizer of a different size or a different scheme when quantization is performed.

In one or more embodiments, the determining of the pitch index may include searching for an optimal pitch period, obtaining a difference between a pitch period of a previous frame and the optimal pitch period, and calculating and determining a pitch index with respect to the difference when the difference is less than a reference value.

In one or more embodiments, the determining of the pitch index may include calculating and determining the pitch index with respect to the optimal pitch period when the difference is greater than the reference value.

In one or more embodiments, the determining of the code index may further include comparing, for the control of the variable bit rate of the code index, the reserved bits with reference values for selecting a predetermined fixed codebook, and selecting a fixed codebook from a plurality of fixed codebooks based on the comparison result.

In one or more embodiments, the determining of the code index may include identifying the fluctuation feature of the reserved bits by comparing a previous reserved bits with the reserved bits, and classifying a criterion for selecting a plurality of fixed codebooks as reference values for an increase feature when the reserved bits represents the increase feature, and selecting a fixed codebook, from the plurality of fixed codebooks as reference values for the increase feature, corresponding to the reserved bits by comparing the reserved bits with the reference values for the increase feature.

In one or more embodiments, the determining of the code index may further include classifying the criterion for selecting a plurality of fixed codebooks as reference values for a decrease feature when the reserved bits represents the decrease feature, and selecting a fixed codebook, from the plurality of fixed codebooks as reference values for the decrease feature, corresponding to the reserved bits.

In one or more embodiments, the determining of the gain VQ index may further include comparing, for control of the variable bit rate of the gain VQ index, the reserved bits with reference values for selecting a predetermined gain quantizer, and selecting a gain quantizer based on the comparison result.

Additional aspects, features, and/or advantages of embodiments will be set forth in part in the description which follows and, in part, will be apparent from the description, or may be learned by practice of the disclosure.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
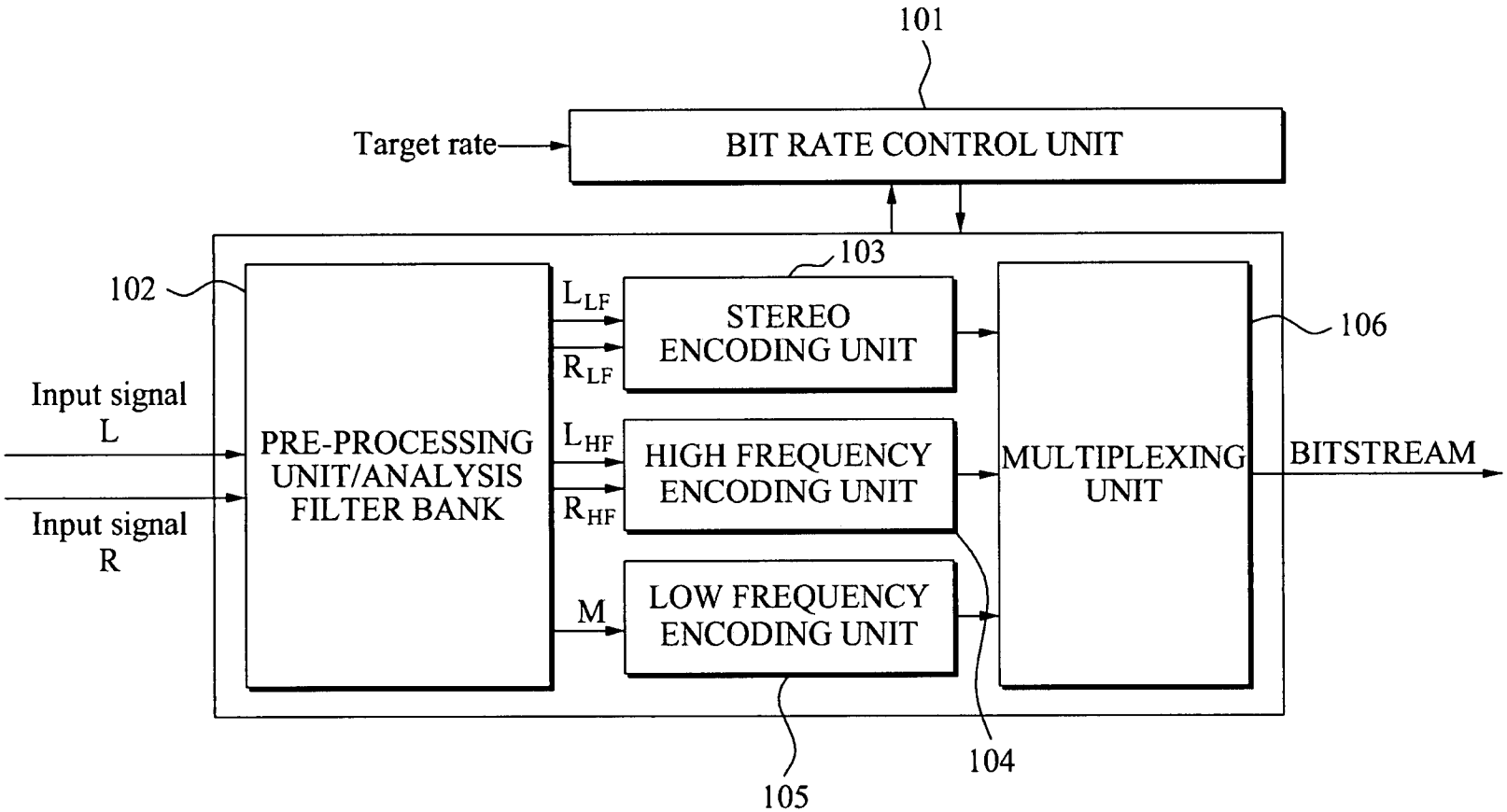
FIG. 1 is a diagram illustrating a configuration of an audio encoder for encoding a speech signal and an audio signal using a variable bit rate according to example embodiments.

Reference will now be made in detail to embodiments, examples of which are illustrated in the accompanying drawings, wherein like reference numerals refer to like elements throughout. In this regard, embodiments of the present invention may be embodied in many different forms and should not be construed as being limited to embodiments set forth herein. Accordingly, embodiments are merely described below, by referring to the figures, to explain aspects of the present invention.

Herein, speech signals include speech signals of voiced sounds and unvoiced sounds and also include audio signals in a speech signal frequency band similar to the speech signals. In addition, herein, variable bit rate refers to a fluctuation of bit rates required to configure frames.

FIG. 1 is a diagram illustrating a configuration of an audio encoder for encoding a speech signal and an audio signal using a variable bit rate according to example embodiments. Referring to FIG. 1, the audio encoder may include a bit rate control unit 101, a pre-processing unit/analysis filter bank 102, a stereo encoding unit 103, a high frequency encoding unit 104, a low frequency encoding unit 105, and a multiplexing unit 106.

The pre-processing unit/analysis filter bank 102 may perform down sampling of signals input from two channels and divide the signals into high frequency signals, low frequency signals, and speech signals. After this, the pre-processing unit/analysis filter bank 102 may provide low frequency signals of the two channels to the stereo encoding unit 103, the high frequency signals of the two channels for the high frequency encoding unit 104, and also the speech signals to the low frequency encoding unit 105.

The stereo encoding unit 103 may encode the low frequency signals of the two channels, input with a variable bit rate which is selected by a control by the bit rate control unit 101.

The high frequency encoding unit 104 may perform encoding of the high frequency signals of the two channels, input with a variable bit rate which is selected by a control by the bit rate control unit 101.

The low frequency encoding unit 105 may encode the speech signals according to variable bit rates which is selected by a control by the bit rate control unit 101 based on source feature and a reserved bits. The low frequency encoding unit 105, which is a speech signal encoding device which encodes the speech signals, is described below in detail with the reference to FIG. 2. The low frequency encoding unit 105 may perform encoding using the variable CELP encoding technique or the variable transform encoding technique.

The multiplexing unit 106 may output multiplexed bit streams including high frequency signals, low frequency signals, and speech signals, all in encoded forms.

The bit rate control unit 101 may receive a target bit rate, and may determine and control variable bit rates for the stereo encoding unit 103, the high frequency encoding unit 104, and the low frequency encoding unit 105.

Operations for the low frequency encoding unit 105 which encodes the speech signals, and the bit rate control unit 101 which controls the variable bit rate are described in greater detail below with the reference to FIG. 2.

Figure 2:
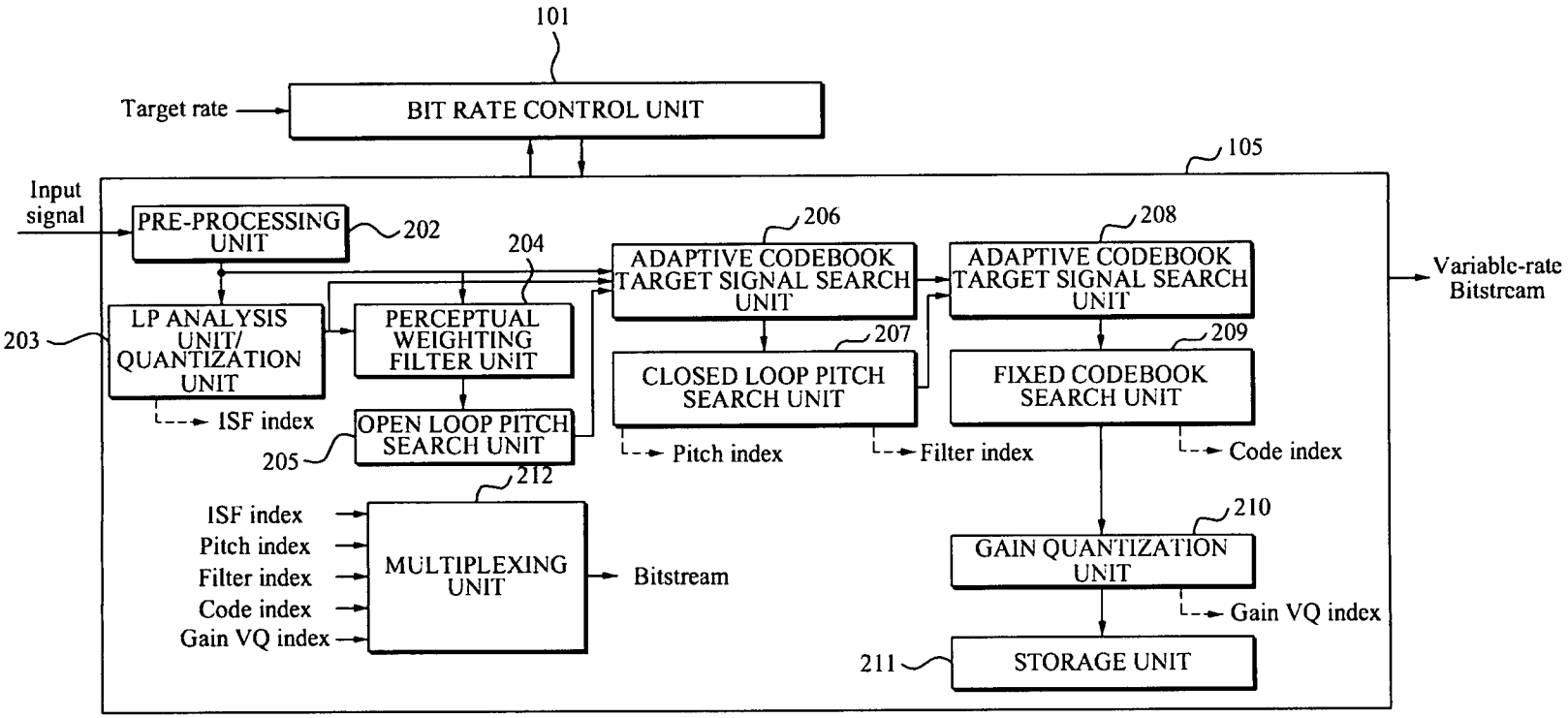
FIG. 2 is a diagram illustrating a configuration of an apparatus for encoding a speech signal using a variable bit rate according to example embodiments.

Referring to FIG. 2, a speech signal encoding device may include the bit rate control unit 101, a pre-processing unit 202, an LP analysis unit/quantization unit 203, a perceptual weighting filtering unit 204, an open loop pitch search unit 205, an adaptive codebook target signal search unit 206, a closed loop pitch search unit 207, a fixed codebook target signal search unit 208, a fixed codebook search unit 209, a gain VQ unit 210, a storage unit 211, and a multiplexing unit 212.

Through a pre-processing operation, the pre-processing unit 202 may remove and filter out undesired frequency elements in input speech signals, and adjust frequency characteristics to be favorable for encoding.

The LP analyzing unit/quantization unit 203 may extract a linear predictive (LP) coefficient from pre-processed speech signals, and perform quantization of the extracted LP coefficient using a quantizer which is selected by the bit rate control unit 101. The LP analyzing unit/quantization unit 203 may also determine an immittance spectral frequencies (ISF) index, which expresses the quantized LP coefficient.

The perceptual weighting filtering unit 204 may receive the LP coefficient and the quantized LP coefficient from the LP analyzing unit/quantization unit 203 and may receive pre-processed speech signals from the pre-processing unit 202. The perceptual weighting filtering unit 204 may construct a perceptual weighting filter using the LP coefficient and the quantized LP coefficient. For the purpose of utilizing a masking effect of a human auditory structure, the perceptual weighting filtering unit 204 may also reduce quantization noise of the speech signals pre-processed via the perceptual weighting filter 204 within a masking range.

The open loop pitch search unit 205 may search for an open loop pitch using filtered output signals output from the perceptual weighting filtering unit 204.

The adaptive codebook target signal search unit 206 may receive the pre-processed speech signals, filtered signals, quantized LP coefficients, and open loop pitch, and using the received signals and coefficients, may calculate adaptive codebook target signals which are target signals used to search for adaptive codebooks.

The closed loop pitch search unit 207 may search for the adaptive codebook using closed loops to determine an optimal pitch period, and determine a pitch index of a size selected by the bit rate control unit 101 which expresses the determined pitch period. Also, the closed loop pitch search unit 207 may employ a predetermined lowpass filter to enhance accuracy of the pitch search. When employing the lowpass filter, an additional filter index may be included for selecting a lowpass filter.

The fixed codebook target signal search unit 208 may generate adaptive codebook vectors filtered through convolution of an impulse response vector and a pitch index (adaptive codebook vector) of the weighting synthesis filter. The fixed codebook target signal search unit 208 may calculate a pitch contribution using a vector and a non-quantized pitch gain, and remove the pitch contribution in the adaptive codebook target signals to obtain the fixed codebook target signal.

The fixed codebook search unit 209, using fixed codebook target signals, may search for a fixed codebook selected by the bit rate control unit 101 to obtain a pulse location and encoding information, and determine the code index which expresses the obtained information. Also, the fixed codebook search unit 209 may generate the fixed codebook excitation signal using the generated code index, and generate the filtered fixed codebook vector through convolution of the impulse response vector and code index (fixed codebook vector) of the weighting synthesis filter.

The gain VQ unit 210, based on fixed codebook excitation signal, may determine fixed codebook target signals, adaptive codebook target signals, a filtered adaptive codebook vector, a filtered-fixed codebook vector, perform quantization of the adaptive codebook and the gain of the fixed codebook using a quantizer selected by the bit rate control unit 101, and determine a gain VQ index.

The storage unit 211 may store states of filters which are shared by the perceptual weighting filter 204 and the speech signal encoding apparatus, for encoding of a subsequent frame.

The multiplexing unit 212 may generate variable bit rate bit streams by including the ISF index, a gain VQ index, the code index, and the pitch index. Here, when the closed pitch search unit 207 employs a lowpass filter, the filter index would additionally be used to generate the variable bit rate bit stream.

The bit rate control unit 101 may determine and control indexes using variable bit rates based on a source feature of speech signals and the reserved bits obtained based on a target bit rate. Specifically, the determination would take into consideration the source feature of speech signals and the reserved bits, which would be based on the target bit rate of the quantizer being used in the LP analyzing unit/quantization unit 203.

The bit rate control unit 101 may determine an amount of bits which are to be allocated to the pitch index in the closed pitch search unit 207 by comparing an optimal pitch period to a previous pitch period.

The bit rate control unit 101 may determine the fixed codebook which is to be employed in the fixed codebook search unit 209 based on the reserved bits and a fluctuation feature of the reserved bits.

The bit control unit 101 may determine the quantizer which is to be used in the gain VQ unit 210 based on the reserved bits. The bit rate control unit 101 may update the reserved bits after indexes are determined in each of the quantizers.

The sequential order of utilized units in the determining of the variable bit rate starts with the LP analyzing unit/quantization unit 203, followed by the closed loop pitch search unit 207, the fixed codebook search unit 209, and the gain VQ unit 210.

When the variable bit rate is controlled based on the reserved bits, the bit rate control unit 101 may select an LP coefficient quantizer which corresponds to the reserved bits by comparing the reserved bits with a predetermined reference value used in selection of the LP coefficient quantizer Also, the bit rate control unit 101 may select the fixed codebook which corresponds to the reserved bits by comparing the reserved bits with the predetermined reference value used in the selection of the fixed codebook. Also, the bit rate control unit 101 may select a gain quantizer which corresponds to the reserved bits by comparing the reserved bits with the predetermined reference value used in the selection of the gain quantizer.

Here, when the variable bit rate is greater than the target bit rate, the reserved bits is expressed with a negative value with the reserved bits matching a difference between the variable bit rate and the target bit rate. Also, when the variable bit rate is less than the target bit rate, the reserved bits is expressed with a positive value with the reserved bits matching a difference between the variable bit rate and the target bit rate. The source feature of the speech signals are characteristics classified by various ranges of the speech signals of silence, voiced sounds, unvoiced sounds, background noises, and the like. Examples of the variable bit rate control by the bit rate control unit 101 are described in detail with reference to FIG. 4 through FIG. 7.

Figure 3:
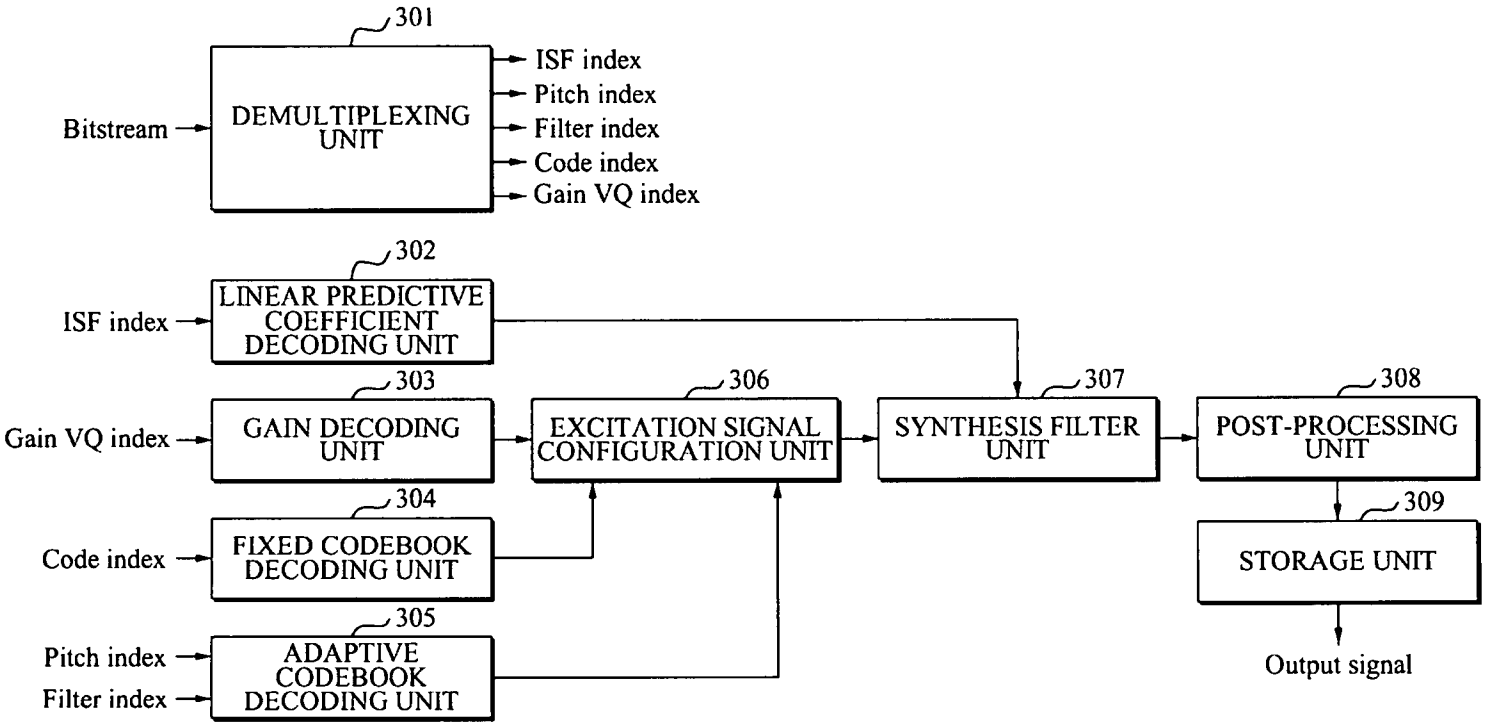
FIG. 3 is a diagram illustrating a configuration of an apparatus for decoding a speech signal which is encoded using a variable bit rate according to example embodiments.

FIG. 3 is a diagram illustrating a configuration of an apparatus for decoding a speech signal which is encoded using a variable bit rate according to example embodiments. Referring to FIG. 3, the apparatus for decoding the speech signal may include a demultiplexing unit 301, an LP coefficient decoding unit 302, a gain decoding unit 303, a fixed codebook decoding unit 304, an adaptive codebook decoding unit 305, an excitation signal configuration unit 306, a synthesis filter unit 307, a post-processing unit 308, and a storage unit 309.

The demultiplexing unit 301 may extract an ISF index, a gain VQ index, a code index, a pitch index, and a filter index by demultiplexing a received variable bit rate bit stream.

The LP coefficient decoding unit 302 may identify the quantization information from the ISF index, and decode an LP coefficient from the ISF index using the identified quantizer.

The gain decoding unit 303 may identify the quantizer information of the gain VQ index, and decode an adaptive codebook and adaptive codebook gains from the gain VQ index using the identified quantizer.

The fixed codebook decoding unit 304 may identify a fixed codebook used in the code index, and decode a fixed codebook vector from the code index using the identified fixed codebook.

The adaptive codebook decoding unit 305 may identify pitch allocation bit information from the pitch index to confirm a pitch index size, and perform decoding of the pitch index to decode the adaptive codebook vector. Here, when the filter index exists, the filter index is applied to the adaptive codebook vector.

The excitation signal configuration unit 306 may multiply each of the gain values by the fixed codebook vector and the adaptive codebook vector, and configure an excitation signal by summing up the multiplied values.

The synthesis filter unit 307 may restore the speech signals by synthesizing the LP coefficient with the excitation signal using the synthesis filter.

The post-processing unit 308 may enhance a sound quality of the speech signal through the post-processing.

The storage unit 309 may update and store a state of each filter used in the decoding for the decoding of the subsequent frame.

Hereinafter, a method for encoding/decoding a speech signal according to example embodiments is described below.

Figure 4:
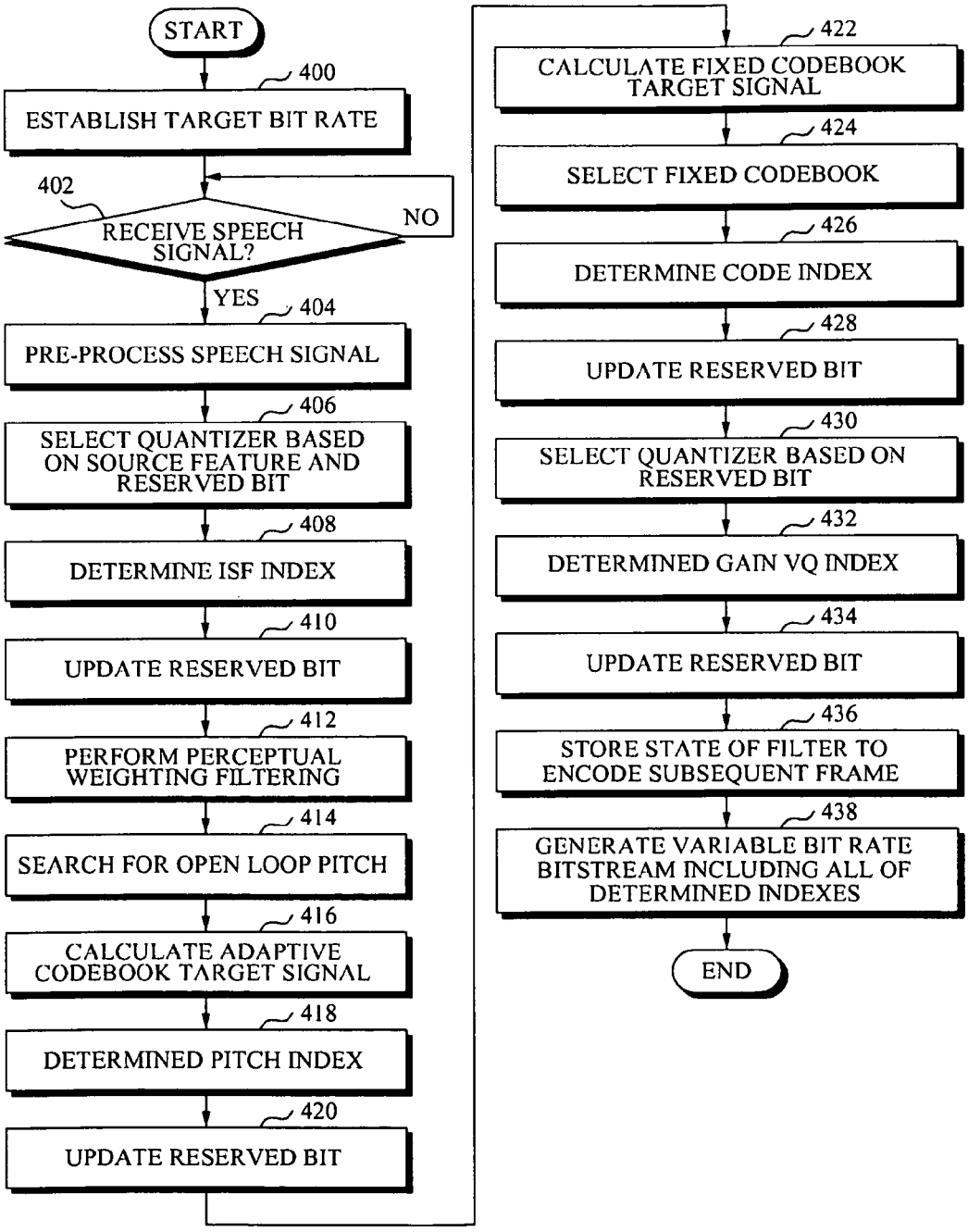
FIG. 4 is a flowchart illustrating operations of encoding a speech signal using a variable bit rate in the apparatus for encoding the speech signal according to example embodiments.

FIG. 4 is a flowchart illustrating operations of encoding a speech signal using a variable bit rate in the apparatus for encoding the speech signal according to example embodiments. Referring to FIG. 4, the apparatus for encoding the speech signal proceeds to operation 400, and establishes a target bit rate prior to the encoding of the speech signal.

Afterward, the apparatus for encoding the speech signal may receive the speech signals 402, and proceeds to operation 404 for the pre-processing in which undesired frequency elements are removed and filtered out from input speech signals. In operation 406, the quantizer is selected for the LP coefficient quantizer index based on a source feature and the reserved bits. In operation 408, the LP coefficient is extracted and quantized using the selected quantizer to determine the LP coefficient quantizer index. Below, the operation of the selecting of the quantizer in operation 406 is described in detail with the reference of FIG. 5.

In operation 408, after the ISF index is determined, the apparatus for encoding the speech signal proceeds to operation 410 and updates the reserved bits, which has been changed due to allocation of the ISF index.

Subsequently, the apparatus for encoding the speech signal proceeds to operation 412, and reduces quantization noise of the speech signals which are pre-processed using a perceptual weighting filter, then searches for a closed loop pitch using the filtered signals in operation 414. In operation 416, the apparatus for encoding the speech signal may calculate an adaptive codebook target signal, and determine a pitch index which expresses an optimal pitch period determined by the searching of the adaptive codebook using the closed loop. The method of determining the pitch index in operation 418 is described in further details below, with reference to FIG. 6.

After the pitch index is determined in operation 418, the apparatus for encoding the speech signal proceeds to operation 420 to update the reserved bits changed by the allocation of the pitch index. In operation 422, a pitch contribution is calculated to remove the pitch contribution from the adaptive codebook target signal and to calculate the fixed codebook target signal. In operation 424, the fixed codebook is selected based on the reserved bits and a fluctuation feature of the reserved bits. The method of selecting the fixed codebook in operation 424 is described in greater detail below with the reference to FIG. 7.

After the fixed codebook is selected in operation 424, the apparatus for encoding the speech signal proceeds to operation 426 to search for the selected-fixed codebook using the fixed codebook target signals to obtain a pulse location and encoding information and also to determine the code index which expresses the obtained information. In operation 428, the reserved bits changed by the allocation of the code index is updated.

After this, the apparatus for encoding the speech signal may select a quantizer which is to quantize gains based on the reserved bits in operation 430. In operation 432, the gains for the adaptive codebook and of the fixed codebook are calculated and quantized using the selected quantizer to determine the gain VQ index.

In operation 432, after the gain VQ index is determined, the apparatus for encoding the speech signal proceeds to operation 434, and updates the reserved bits changed by the allocation of the gain VQ index. In operation 436, the state of the various filters in the perceptual weighting filter and other filters are stored for the purpose of encoding subsequent frames. In operation 438, a variable bit rate bit stream is generated or stored by synthesizing all the determined indexes.

Figure 5:
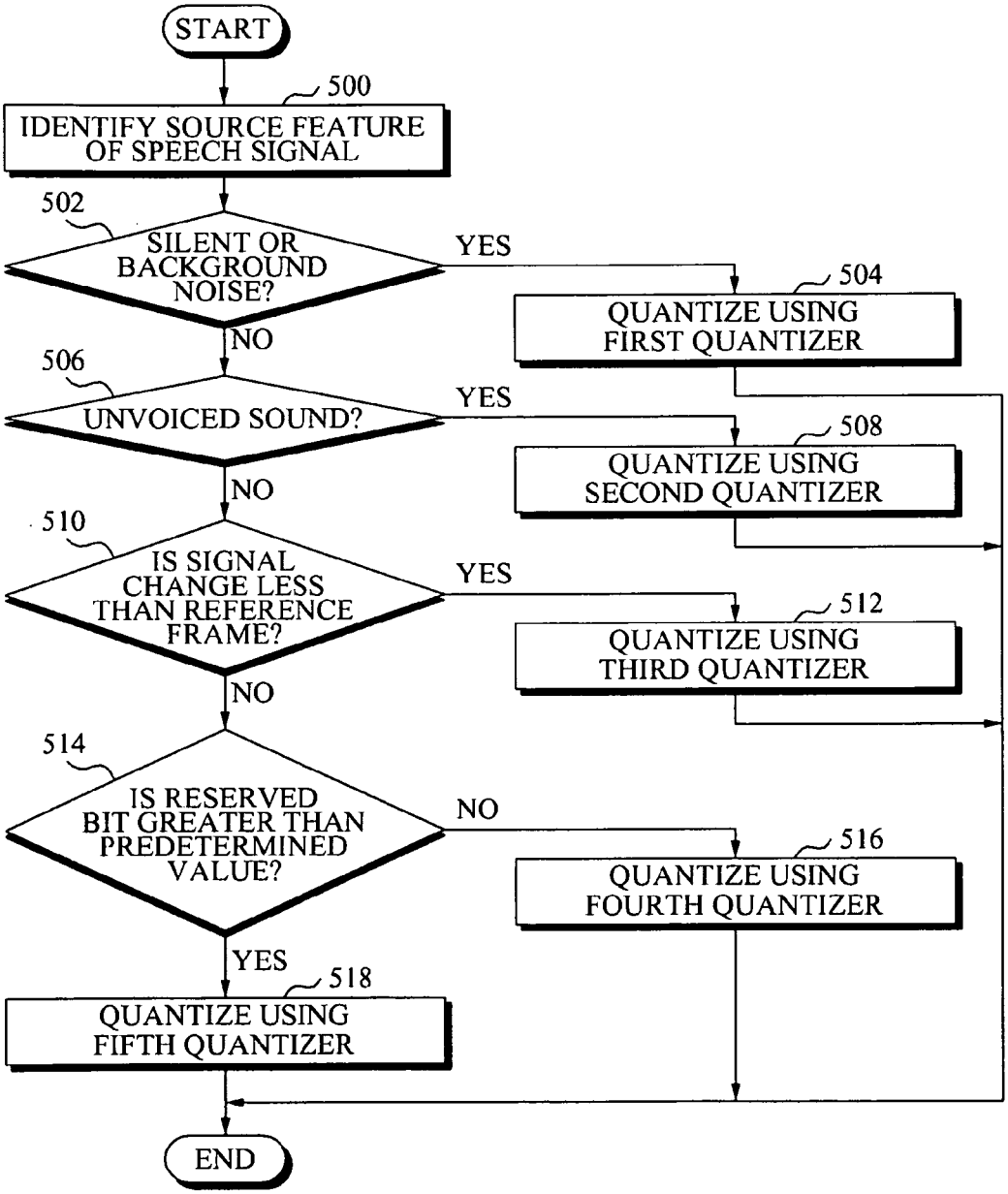
FIG. 5 is a flowchart illustrating operations of quantizing a linear predictive coefficient based on a source feature and reserved bits in the apparatus for encoding the speech signal according to example embodiments.

FIG. 5 is a flowchart illustrating operations of quantizing a linear predictive coefficient based on a source feature and a reserved bit rate in the apparatus for encoding the speech signal according to example embodiments.

Referring to FIG. 5, the apparatus for encoding the speech signal may identify a source feature of the speech signal in operation 500, and determine whether the identified source feature is silence or a background noise. When the identification result indicates that the source feature is a silence or background noise, an LP coefficient is quantized using a first quantizer in operation 504.

When the identification result does not indicate that the source feature is silence or background noise, the apparatus for encoding the speech signal proceeds to operation 506 to determine whether the source feature of the speech signal is silence or the background noise. When the source feature of the speech signal is unvoiced sound, the LP coefficient is quantized using a second quantizer in operation 508.

When the source feature of the speech signal is not unvoiced sound in operation 506, the apparatus for encoding the speech signal proceeds to operation 508 to determine whether a signal change of the source feature of the speech signals is less than a signal change of a reference frame. When the change of the source feature of the speech signals is less than the signal change of the reference frame, the LP coefficient is quantized using a third quantizer in operation 512.

When the signal change of the speech signal is greater than or equal to that of the reference frame in operation 510, the apparatus of encoding the speech signal proceeds to operation 514 to determine whether the reserved bits is greater than a predetermined value. When the reserved bits is less than the predetermined value, the LP coefficient is quantized using a fourth quantizer.

When the reserved bits is greater than the predetermined value in operation 514, the apparatus for encoding the speech signal proceeds to operation 518 to quantize the LP coefficient using a fifth quantizer The first through fifth quantizers may perform quantization using respective predetermined numbers of bits. Here, for example, regarding the number of bits utilized by each quantizer, the first quantizer may utilizes only a least significant bit, while the fifth quantizer may utilize bits including a most significant bit.

Figure 6:
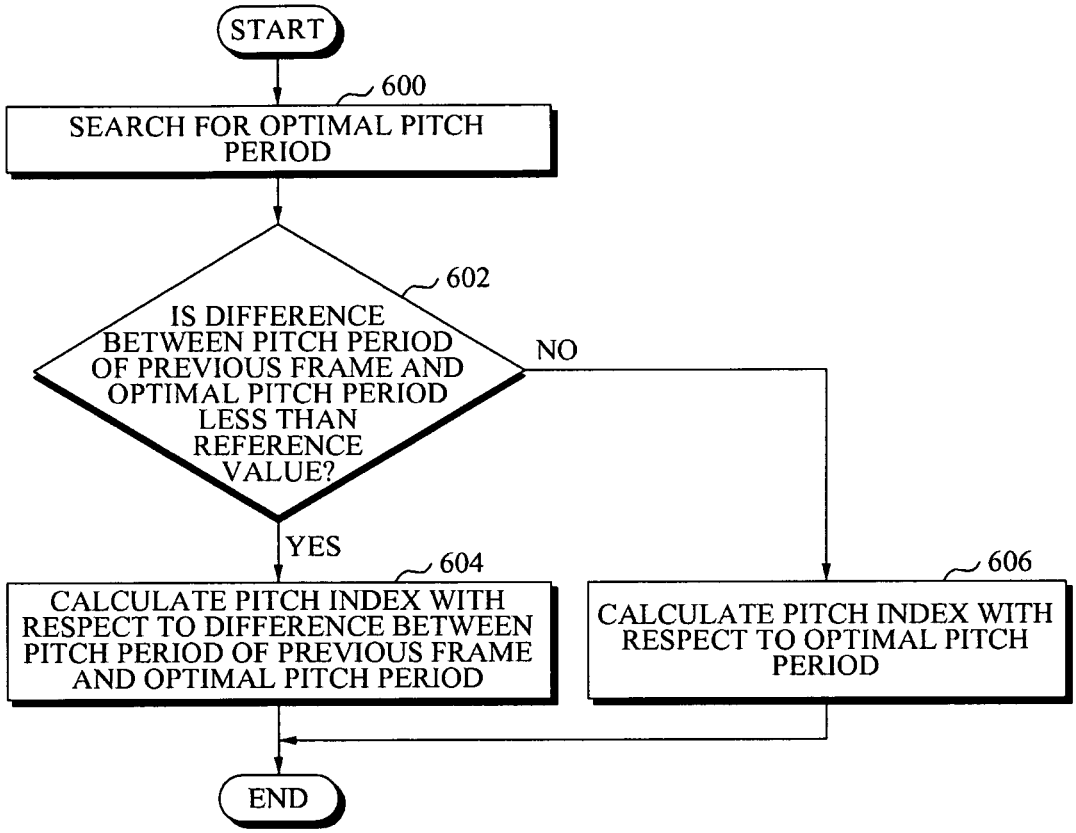
FIG. 6 is a flowchart illustrating operations of determining a pitch index in the apparatus for encoding the speech signal according to example embodiments.

FIG. 6 is a flowchart illustrating operations of determining a pitch index in the apparatus for encoding the speech signal according to example embodiments.

Referring to FIG. 6, in operation 600, the apparatus for encoding the speech signal may search for an adaptive codebook using the closed loop to determine an optimal pitch period, and determine whether a difference between a pitch period of a previous frame and the optimal pitch period is less than the reference value.

When the difference between the pitch period of the previous frame and the optimal pitch period is less than the reference value, the apparatus for encoding the speech signal proceeds to operation 604 to determine a pitch index by calculating the difference between the pitch period of the previous frame and the optimal pitch period.

However, when the difference between the pitch period of the previous frame and the optimal pitch period is greater than the reference value, the apparatus for encoding the speech signal proceeds to operation 606 to determine the pitch index with respect to the optimal pitch period.

In operation 602, the reference value used in the comparison of the optimal pitch period with the difference of the pitch period of the previous frame may be at least one, and according to a range of each of the reference values, a pitch allocation bit, which is a bit expressing the pitch index, may be determined. Here, the pitch allocation index may be included in the pitch index generated in both operations 604 and 606.

Figure 7:
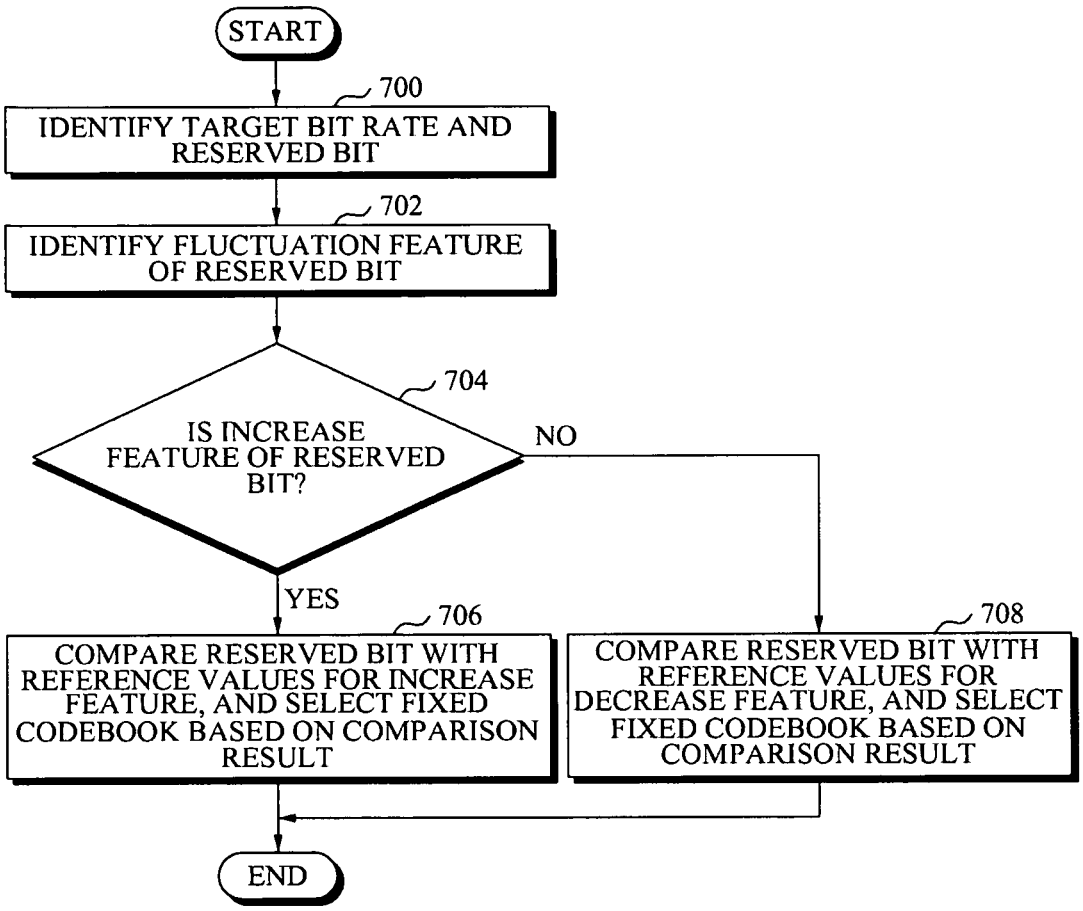
FIG. 7 is a flowchart illustrating operations of selecting a fixed codebook based on reserved bits in the apparatus for encoding the speech signal according to example embodiments.

FIG. 7 is a flowchart illustrating operations of selecting a fixed codebook based on reserved bits in the apparatus for encoding the speech signal according to example embodiments. Referring to FIG. 7, the apparatus for encoding the speech signal proceeds to operation 700 to select a fixed codebook, and to identify a target bit rate and the reserved bits. In operation 702, the apparatus for encoding the speech signal may identify a fluctuation feature of the reserved bits, which represents whether the reserved bits is increasing or decreasing by comparing a present reserved bits with a previous reserved bits.

After this, the apparatus for encoding the speech signal may determine whether the reserved bits represents an increase feature in operation 704.

When the reserved bits represents the increase feature, the apparatus for encoding the speech signal may select a fixed codebook which corresponds to the reference value among the fixed codebooks by comparing the reserved bits with a reference value for an increase feature corresponding to each codebook in operation 706.

When the reserved bits represents a decrease feature in the process 704, the apparatus for encoding the speech signal may select the fixed codebook which corresponds to the reference value for a decrease feature among the fixed codebooks by comparing the reserved bits with the reference value for the decrease feature corresponding to each codebook. With respect to the fixed codebooks selected in operations 706 and 708, the increase feature and the decrease feature are predetermined for selection of a fixed codebook, in which a greater number of bits of a corresponding code index are searched as the reserved bits increases.

Conversely, when the reserved bits is increased or decreased in FIG. 7, termination of a fixed codebook to be selected are identical. However, the reason the increase feature and the decrease feature are differently configured is to prevent frequent changes in the selection for the fixed codebook, since the reserved bits changes between a single reference value when the reference value is one.

Figure 8:
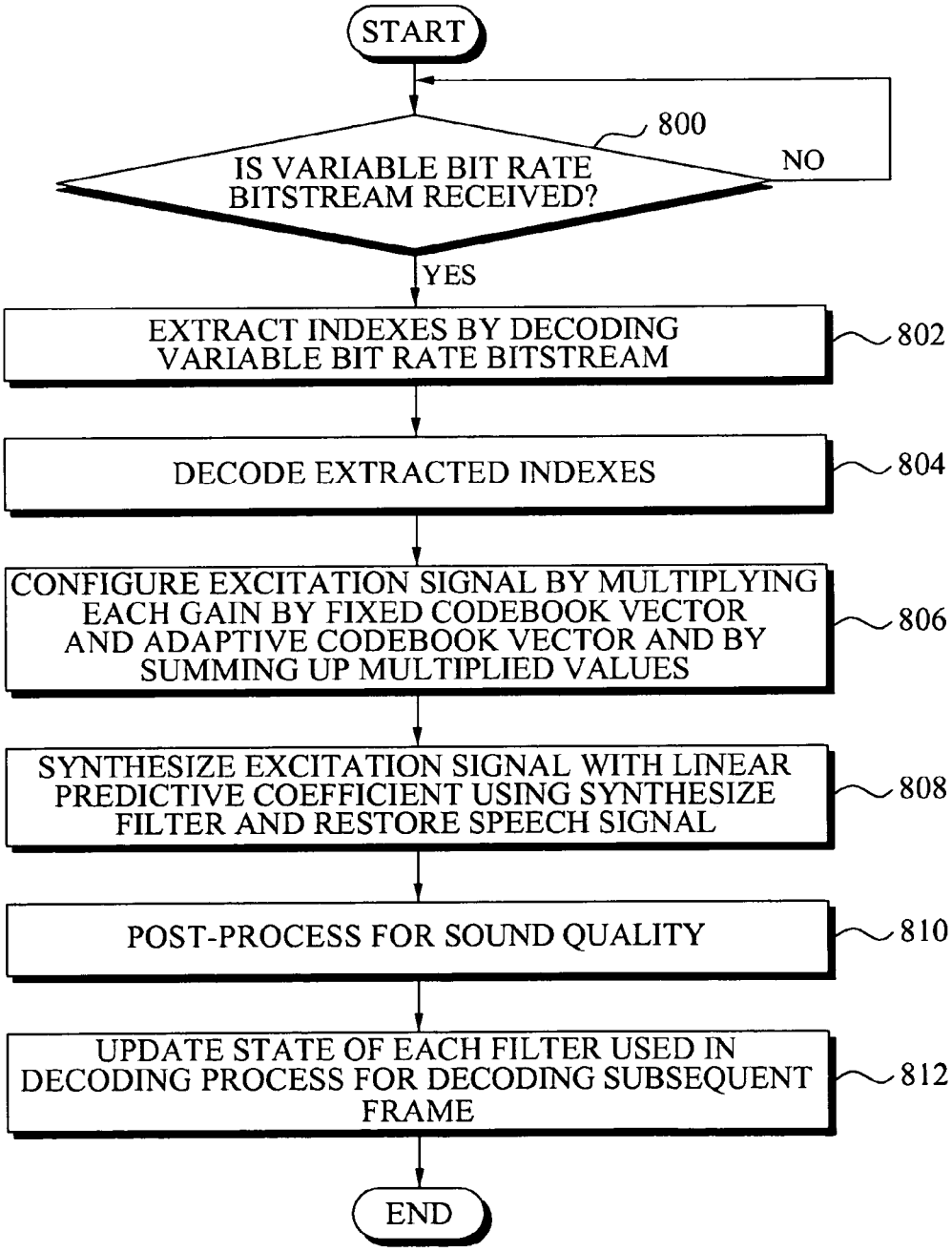
FIG. 8 is a flowchart illustrating operations of decoding a speech signal which is encoded using a variable bit rate in the apparatus for decoding the speech signal according to example embodiments.

FIG. 8 is a flowchart illustrating operations of decoding a speech signal which is encoded using a variable bit rate in the apparatus for decoding the speech signal according to example embodiments.

Referring to FIG. 8, when a variable bit rate bit stream is received in operation 800, the apparatus for decoding the speech signal proceeds to operation 802 to perform decoding of the variable bit rate bit stream and to extract the indexes. The extracted indexes may include an ISF index, a gain VQ index, a code index, and a pitch index, and may also include an additional filter index.

After this, the apparatus for decoding the speech signal may perform decoding of the extracted indexes in operation 804. Observing the decoding of the indexes in greater detail, quantization information may be identified from the ISF index, and using the identified quantizer, the LP coefficient may be decoded using the ISF index. From the gain VQ index, the quantizer information may be identified and the identified quantizer may then be used, such that gains for the adaptive codebook and for the fixed codebook may be decoded using the gain VQ index. After the fixed codebook used in the code index is identified, a fixed codebook vector may be decoded using the code index using the identified fixed codebook index. In a pitch index, pitch allocation bit information is identified to obtain a size of the pitch index, and the adaptive codebook vector may be decoded by decoding the pitch index. Here, when a filter index exists, the filter index is applied to the adaptive codebook vector.

After decoding the indexes in operation 804, the apparatus for decoding the speech signal may perform operation 806 to multiply gain values of the fixed codebook vector and the adaptive codebook vector, and may configure an excitation signal by summing up the multiplied values. Subsequently, the apparatus for decoding the speech signal may perform operation 808 to synthesize the excitation signal with an LP coefficient using the synthesis filter to restore the speech signal.

The apparatus for decoding the speech signal proceeds to operation 810 and performs post-processing for improvement of a sound quality of the restored speech signal. In operation 812, a filter state of each filter used in the decoding process is updated and stored for a subsequent decoding process of a subsequent frame.

In addition to the above described embodiments, embodiments can also be implemented through computer readable code/instructions in/on a medium, e.g., a computer readable medium, to control at least one processing device to implement any above described embodiment. The medium can correspond to any defined, measurable, and tangible structure permitting the storing and/or transmission of the computer readable code.

The computer readable code can be recorded included in/on a medium, such as a computer-readable media, and the computer readable code may include program instructions to implement various operations embodied by a processing device, such a processor or computer, for example. The media may also include, e.g., in combination with the computer readable code, data files, data structures, and the like.

Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Examples of computer readable code include both machine code, such as produced by a compiler, and files containing higher level code that may be executed by the computer using an interpreter, for example. The media may also be a distributed network, so that the computer readable code is stored and executed in a distributed fashion. Still further, as only an example, the processing element could include a processor or a computer processor, and processing elements may be distributed and/or included in a single device.

While aspects of the present invention has been particularly shown and described with reference to differing embodiments thereof, it should be understood that these exemplary embodiments should be considered in a descriptive sense only and not for purposes of limitation. Descriptions of features or aspects within each embodiment should typically be considered as available for other similar features or aspects in the remaining embodiments.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. An apparatus for encoding a speech signal, the apparatus comprising:

a linear predictive (LP) analysis unit/quantization unit to determine an immittance spectral frequencies (ISF) index;

a closed loop pitch search unit to determine a pitch index;

a fixed codebook search unit to determine a code index;

a gain vector quantization (VQ) unit to determine a gain VQ index of each of an adaptive codebook and a fixed codebook; and a bit rate control unit to control at least two indexes of the ISF index, the pitch index, the code index, and the gain VQ index to be encoded at a variable bit rate, wherein the bit rate control unit compares reserved bits with a reference value, and selects a linear predictive coefficient quantizer for control of the variable bit rate of the ISF index, based on a result of the comparison.

2. The apparatus of claim 1, wherein the bit rate control unit compares the reserved bits with references values for selecting a linear predictive coefficient quantizer for control of the variable bit rate of the ISF index, and selects a linear predictive coefficient quantizer based on a result of the comparison.

3. The apparatus of claim 1, wherein the bit rate control unit selects a first quantizer for control of the variable bit rate of the ISF index when the source feature is silence or a background noise, selects a second quantizer when the source feature is an unvoiced sound, selects a third quantizer when the source feature is a voiced sound and a signal change of the speech signal is less than a signal change of a reference frame, selects a fourth quantizer when the source feature is a voiced sound and the reserved bits is less than a predetermined value and a signal change of the speech signal is greater than or equal to a signal change of the reference frame, and selects a fifth quantization when the source feature is a voiced sound and the reserved bits is greater than the predetermined value and a signal change of the speech signal is greater than or equal to a signal change of the reference frame.

4. The apparatus of claim 3, wherein each of the first quantizer, the second quantizer, the third quantizer, the fourth quantizer, and the fifth quantizer respectively use quantizers of different sizes or different schemes when quantization is performed.

5. The apparatus of claim 3, wherein the ISF index comprises quantizer information which is selected for ISF in the bit rate control unit.

6. The apparatus of claim 1, wherein the bit rate control unit searches for an optimal pitch period for control of the variable bit rate of the pitch index, and calculates and determines a pitch index with respect to a difference between a pitch period of a previous frame and the optimal pitch period when the difference is less than a reference value.

7. The apparatus of claim 6, wherein the bit rate control unit calculates and determines the pitch index with respect to the optimal pitch period when the difference is greater than the reference value.

8. The apparatus of claim 6, wherein the pitch index comprises a pitch allocation bit which includes information about an amount of bits expressing the pitch index.

9. The apparatus of claim 1, wherein the bit rate control unit compares, for control of the variable bit rate of the code index, the reserved bits with reference values for selecting a predetermined fixed codebook, and selects a fixed codebook based on a result of the comparison.

10. The apparatus of claim 1, wherein the bit rate control unit identifies a fluctuation feature of the reserved bits by comparing a previous reserved bits with the reserved bits for control of the variable bit rate of the code index, classifies a criterion for selecting a plurality of fixed codebooks as reference values for an increase feature when the reserved bits represents the increase feature, and selects a fixed codebook, from the plurality of fixed codebooks as the reference values for the increase feature, corresponding to the reserved bits.

11. The apparatus of claim 10, wherein the bit rate control unit classifies the criterion for selecting a plurality of fixed codebooks as reference values for a decrease feature when the reserved bits represents the decrease feature, and selects a fixed codebook, from the plurality of fixed codebooks as the reference values for the decrease feature, corresponding to the reserved bits.

12. The apparatus of claim 10, wherein the code index comprises information about the selected fixed codebook.

13. The apparatus of claim 1, wherein the bit rate control unit compares, for control of the variable bit rate of the gain VQ index, the reserved bits with reference values for selecting a predetermined gain quantizer, and selects a gain quantizer based on a result of the comparison.

14. The apparatus of claim 1, wherein the bit rate control unit selects a predetermined quantizer corresponding to the reserved bits for control of the variable bit rate of the gain VQ index when a gain is quantized.

15. The apparatus of claim 14, wherein the gain VQ index comprises the selected quantizer information.

16. An apparatus for decoding a speech signal, the apparatus comprising:

a demultiplexing unit to receive and to demultiplex a variable bit rate bitstream, and to extract an immittance spectral frequencies (ISF) index, a gain vector quantization (VQ) index, a code index, and a pitch index from the variable rate bitstream with at least two indexes of the ISF index, the gain VQ index, the code index, and the pitch index having been encoded at a variable bit rate;

a linear predictive coefficient decoding unit to decode a linear predictive coefficient using quantizer information included in the ISF index;

a gain decoding unit to decode an adaptive codebook gain and a fixed codebook gain using the quantizer information included in the gain VQ index;

a fixed codebook decoding unit to decode a fixed codebook vector using fixed codebook information used in the code index;

an adaptive codebook decoding unit to decode an adaptive codebook vector using pitch allocation bit information included in the pitch index;

an excitation signal configuration unit to configure an excitation signal using the decoded adaptive codebook gain and fixed codebook gain; and a synthesis filter unit to synthesize the excitation signal with the ISF index, wherein the quantizer information included in the ISF index indicates a linear predictive coefficient quantizer selected for control of the variable bit rate of the ISF index, based on a comparison between reserved bits and a reference value.

17. A method for encoding a speech signal, the method comprising:

determining, using at least one processing device, an immittance spectral frequencies (ISF) index;

determining a pitch index;

determining a code index from a fixed codebook;

determining a gain vector quantization (VQ) index; and generating a variable rate bitstream including the ISF index, the pitch index, the code index, and the gain VQ index, the variable rate bitstream with at least two indexes of the ISF index, the gain VQ index, the code index, and the pitch index encoded at a variable bit rate, wherein compares reserved bits with a reference value, and selects a linear predictive coefficient quantizer for control of the variable bit rate of the ISF index, based on a result of the comparison.

18. The method of claim 17, wherein the determining of the ISF index further comprises:

comparing the reserved bits with reference values for selecting a linear predictive coefficient quantizer for control of the variable bit rate of the ISF index; and selecting a linear predictive coefficient quantizer based on a result of the comparison.

19. The method of claim 17, wherein the determining of the ISF index comprising:

identifying the source feature and the reserved bit rate;

selecting a first quantizer for the control of the variable bit rate of the ISF index when the source feature is silence or a background noise;

selecting a second quantizer when the source feature is an unvoiced sound; and selecting a third quantizer when the source feature is a voiced sound and when a signal change of the speech signal is less than a signal change of a reference frame, selecting a fourth quantizer when the source feature is a voiced sound and a signal change of the speech signal is greater than or equal to a signal change of the reference frame and the reserved bits is less than a predetermined value, and selecting a fifth quantization when the source feature is a voiced sound and a signal change of the speech signal is greater than or equal to a signal change of the reference frame and the reserved bits is greater than the predetermined value.

20. The method of claim 19, wherein each of a first quantizer, a second quantizer, a third quantizer, a fourth quantizer, and a fifth quantizer respectively use quantizers of different sizes or different schemes when quantization is performed.

21. The method of claim 17, wherein the determining of the pitch index comprises:

searching for an optimal pitch period;

obtaining a difference between a pitch period of a previous frame and the optimal pitch period; and calculating and determining a pitch index with respect to the difference when the difference is less than a reference value.

22. The method of claim 21, further comprising:

calculating and determining the pitch index with respect to the optimal pitch period when the difference is greater than the reference value.

23. The method of claim 17, wherein the determining of the code index further comprises:

comparing, for control of the variable bit rate of the code index, the reserved bits with reference values for selecting a predetermined fixed codebook from a plurality of fixed codebooks; and selecting a fixed codebook from the plurality of fixed codebooks based on a result of the comparison.

24. The method of claim 17, wherein the determining of the code index comprises:

identifying a fluctuation feature of the reserved bits by comparing a previous reserved bits with the reserved bits; and classifying a criterion for selecting a plurality of fixed codebooks as reference values for an increase feature when the reserved bits represents the increase feature, and selecting a fixed codebook, from the plurality of fixed codebooks as the reference values for the increase feature, corresponding to the reserved bits by comparing the reserved bits with the reference values for the increase feature.

25. The method of claim 24, wherein the determining of the code index further comprises:

classifying the criterion for selecting a plurality of fixed codebooks as reference values for a decrease feature when the reserved bits represents the decrease feature; and selecting a fixed codebook, from the plurality of fixed codebooks as reference values for a decrease feature, corresponding to the reserved bits.

26. The method of claim 17, wherein the determining of the gain VQ index further comprises:

comparing, for control of the variable bit rate of the gain VQ index, the reserved bits with reference values for selecting a predetermined gain quantizer; and selecting a gain quantizer based on a result of the comparison.

* * * * *